United States Patent [19]

Sugawara

[11] Patent Number: 4,967,953

[45] Date of Patent: Nov. 6, 1990

[54] PARTITIONED BOX WITH LIGHT REFLECTIVE PARTITION SURFACE AND WINDOW

[75] Inventor: Shigeru Sugawara, Tokyo, Japan

[73] Assignee: Tenyo Co., Ltd., Tokyo, Japan

[21] Appl. No.: 381,075

[22] Filed: Jul. 18, 1989

[30] Foreign Application Priority Data

Mar. 22, 1989 [JP] Japan ..... 1-31414[U]
Apr. 17, 1989 [JP] Japan ..... 1-44016[U]

[51] Int. Cl.[5] ..... B65D 91/00

[52] U.S. Cl. ..... 232/1 D; D99/36; 446/8; 217/11

[58] Field of Search ..... 232/1 D; D99/34, 35, D99/36; 217/11, 12 R; 446/8; 220/82 R

[56] References Cited

U.S. PATENT DOCUMENTS

D. 175,806 10/1955 Stawniak et al. ..... D99/36 X
D. 176,043 11/1955 Senior et al. ..... D99/36
D. 304,644 11/1989 Silcox ..... D99/36
4,560,257 12/1985 Otema ..... 217/11 X
4,815,998 3/1989 McGuire ..... 446/8

*Primary Examiner*—Robert W. Gibson, Jr.
*Attorney, Agent, or Firm*—Sixbey, Friedman, Leedom & Ferguson

[57] ABSTRACT

A visually pleasing box according to the present invention has six opaque panels. A light transmissible window is provided at one panel and a partition plate for dividing the interior of the box body into two half spaces is disposed on a flat face defined by one diagonal line of a given panel among the four panels abutting the panel formed with the window and other diagonal line of a panel opposite to the given panel and parallel to the diagonal line of the given panel. Furthermore, a light-reflective area is provided on a surface of the partition plate substantially over the entire surface thereof and facing the window. Thus, the reflecting operation of the reflective area is utilized to be visually pleased, and the box in which the state and the utility can be variably modified as a saving box, pencil stand box, flower stand box, stock box ornament box, etc. can be provided.

25 Claims, 12 Drawing Sheets

PARTITIONED BOX WITH LIGHT REFLECTIVE PARTITION SURFACE AND WINDOW

BACKGROUND OF THE INVENTION

(a) Field of the Invention

This invention relates to a box which is pleasing to look at by utilizing a reflecting face (so-called a mirror) and in which its state and utility can be modified variably as a saving box, a pencil stand box, a flower stand box, a stock box or an ornament box, etc.

SUMMARY OF THE INVENTION

An object of the present invention is to provide a box which is pleasing to look at and in which its state and utility can be modified variably as a saving box, a pencil stand box, a flower stand box, a stock box or an ornament box, etc.

In order to achieve the above-described object,there is provided according to the present invention a box having six opaque panels comprising, a light transmissible window provided on any one of the six panels, a partition plate for dividing the interior of the box into two spaces, which is disposed on a flat face defined by one diagonal line of a given panel among the four panels abutting the panel formed with the window and one diagonal line of other panel facing the given panel and parallel to the diagonal line of the given panel, and a light-reflective area provided on a surface of the partition plate substantially over the entire surface thereof and facing the window.

There is also provided according to the present invention a box having six opaque panels comprising, two light transmissible windows provided on the adjacent two panels, a partition plate for dividing the interior of the box into two spaces, which is disposed on a flat face defined by one diagonal line of a given panel abutting to the both panels formed with the windows and one diagonal line of other panel facing the given panel and parallel to the diagonal line of the given panel, and two light-reflective areas provided on both surfaces of the partition plate, each area substantially over the entire surface of the partition plate and facing the window.

The box according to the present invention provided with the window at one panel of the box and with the reflecting surface on the opposite face of the partition plate to the window in the constitution described above can be employed as a saving box by providing a coin depositing port communicating with a space opposite to the space of the box at the side of the window at the panel for defining the opposite space, as a pencil stand box by providing a pencil insertion hole, as a flower stand box by opening the above-described panel, and further as a stock box by detachably composing the above-described panel. Therefore, the state or utility of the box can be variably modified for a saving box, a pencil stand box, a flower stand box or a stock box by altering the state or utility of the box.

In the box according to the present invention provided with the window only at one panel of the box and with the reflecting surface on the opposite face of the partition plate to the window in the constitution described above, the inner face of the space of the reflecting surface side (the side of observing the box from the window) is reflected and projected, and the inner face projected on the reflecting surface is observed as the inner face of the space opposite to the space of the above-described reflecting surface side. As a result, when the interior of the box is observed from the window of the above-described reflecting surface side, it is observed as the hollow box having no partition plate having the reflecting surface. Therefore, when the box is employed as the above-described saving box, pencil stand box, flower stand box, or stock box, even if the interior of the box is observed from the window by the reflecting operation of the above-described reflecting surface, the space opposite to the window is concealed by the partition plate having the reflecting plate, coins, pencils, nursery of the flowers, or articles contained in the space is observed as being vanished, thereby pleasing with eyes.

Another object of the present invention is to provide a box which is pleasing to look at and which is further provided with a decorating effect by disposing an ornament in the space of the window side in the box in the above-described box.

Still another object of the present invention is to provide a box in which the edge of a partition plate having a reflecting surface is camouflaged by covering the inner face of a space of the window side in the above-described box with a pattern to enhance the vanishing effect of the above-described coins, pencils, nursery of the flowers, articles.

Still another object of the invention is to provide a box in which its panel provided with a coin deposit port is openable and which has a locking mechanism of the openable panel in the above-described saving box, thereby performing a function as the saving box.

According to the box of the present invention provided with windows at the two adjacent panels of the box and with reflecting surfaces on both faces of a partition plate opposite to the window, visual effect articles, such as different ornaments or patterns are provided in two spaces, thereby employing it as an ornament. In this case, the visual effect article, such as the ornament or pattern observed from one window and the visual effect article, such as the ornament or pattern observed from the other window are different, thereby further enhancing the pleasant decorating effect.

BRIEF DESCRIPTION OF THE DRAWINGS

FIGS. 1 to 8 show a first embodiment of a box for use as a saving box according to the present invention, wherein FIG. 1 is an exploded perspective view of the embodiment, FIG. 2 is a perspective view of its using state, FIG. 3 is a sectional view taken along the line III—III in FIG. 2, FIG. 4 is a sectional view taken along the line IV—IV in FIG. 3 showing a back panel and a locking mechanism, FIG. 5 is a sectional view similar to FIG. 3 with the box turned upside down, FIG. 6 is a sectional view taken along the line VI—VI in FIG. 5 showing a back panel and a locking mechanism, FIG. 7 is a perspective view of the state wherein a flat panel (openable panel) is opened, and FIG. 8/is a partially enlarged sectional view showing guide portions of a flat panel and right and left side panels;

FIGS. 9 to 11 show a second embodiment of a box for use as a saving box according to the present invention, wherein FIG. 9 is an exploded perspective view of the state in which the box is in a stereoscopic shape, FIG. 10 is a perspective view of its use state, and FIG. 11 is a sectional view taken along the line XI—XI in FIG. 10;

FIGS. 18 to 21 show an eighth embodiment of a box for use as an ornament box according to the present invention, wherein FIG. 18 is an exploded perspective view of the box in a stereoscopic shape, FIG. 19 is a perspective view of of its front face side, FIG. 20 is a perspective view of its right side face side, and FIG. 21 is a sectional view taken along the line XXI—XXI in FIG. 19.

DETAILED DESCRIPTION OF PREFERRED EMBODIMENTS

Figure 1:
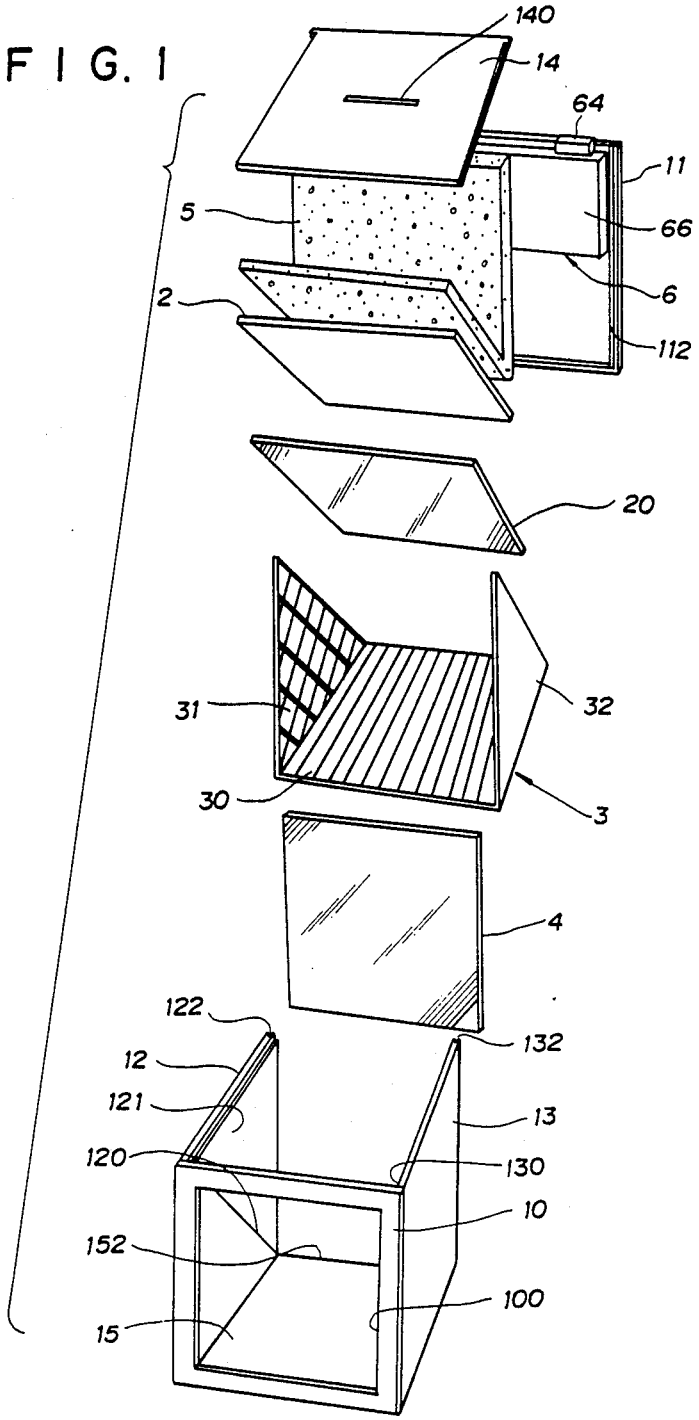

FIGS. 1 to 8 show a first embodiment of a box applied as a saving box according to the present invention.

In the drawings, reference numeral 1 denotes a box. The box 1 is formed in a stereoscopic (hexahedral) hollow shape having substantially equal inner and outer heights and depth, and composed of a front panel 10, a back panel 11, a left side panel 12, a right side panel 13, a flat panel (openable panel) 14 and a bottom panel 15.

Figure 3:
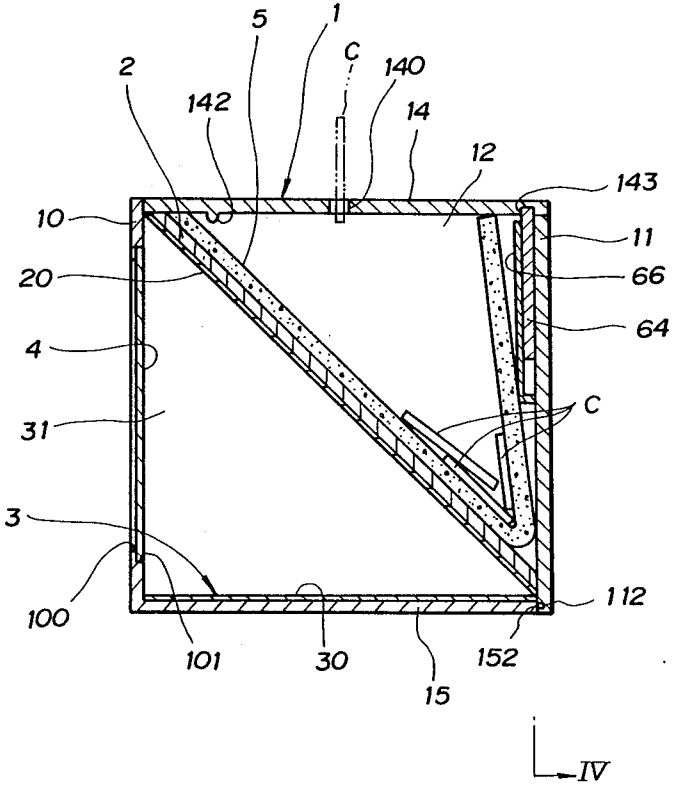

A square-shaped light transmissible window 100 is opened at one panel, such as the front panel 10. A square-shaped stepped portion 101 which is slightly larger than the window 100 is formed at the inner edge of the window 100 of the front panel 10, as best seen in FIG. 3.

Small grooves 112 are so formed at both right and left side edges and lower edges of the inner face of the back panel 11 as to oppositely face the small ribs 122, 132 and 152 of both the left and right side panels 12 and 13, and the bottom panel 15 to be described later.

Stepped portions 120 and 130 are respectively formed along parallel diagonal lines of the inner faces of the two opposite panels, such as left and right side panels 12 and 13 of the front panel 100 formed with the window 10 and the four panels except the back panel 11 opposite to the front panel 10 (that is, the stepped portions 120 and 130 are formed on diagonal lines connecting the corners formed at the front panel 10 with the flat panel 14 to the corners formed at the back panel 11 with the bottom panel 15). Guide recessed surfaces 121 and 131 of triangular sectional shape are formed on the inner faces of the upper edges of the left and right side panels 12 and 13. The small ribs 122 and 132 are formed at the end faces of the left and right side panels 12 and 13 at the side of the back panel 11.

Figure 7:
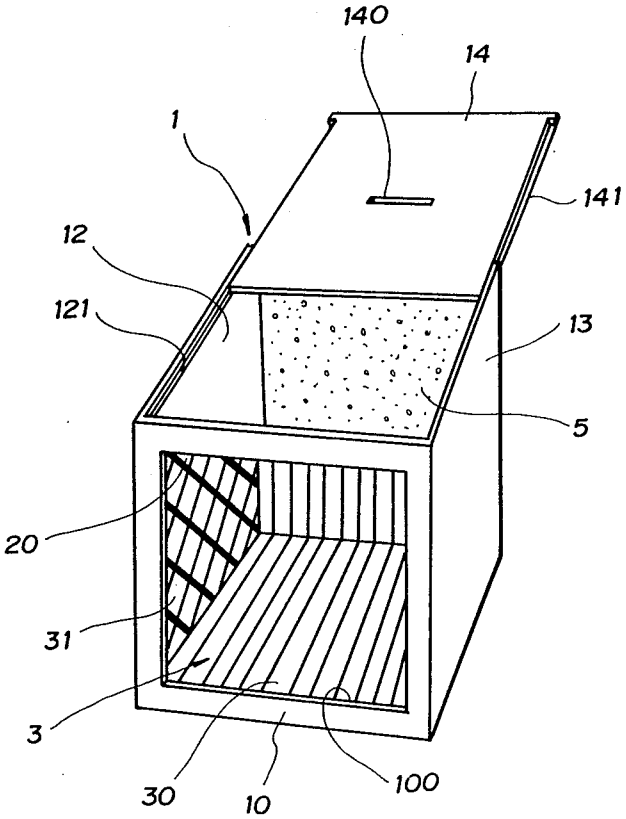

A slender coin deposit port 140 is provided in communication with an opposite space to the space of the side of the window 10 of the box 1 and is formed at the center of the flat panel 14. Guides 141, as seen in FIG. 7, of triangular sectional shape are formed at both the left and right side edges of the flat panel 14. A stopper 142 protrudes substantially at the center of the front inner face of the flat panel 14, and two locking holes 143 are formed (at the positions opposite to a locking unit 64 to be described later at the time of closing the flat panel 14) on the inner back face of the flat panel 14.

A small rib 152 is formed on the end face of the bottom panel 15 at the side of the back panel 11.

As described above, the front panel 10, the left and right side panels 12 and 13, and the bottom panel 15 are preferably integrally molded by injection molding or the like, while the back panel 11 and the flat panel 14 are separately molded. The small grooves 112 of the back panel 11 are engaged with the small ribs 122, 132, 152 of both the left and right side panels 12, 13 and the bottom panel 15, and fixed by fusion-bonding or adhering thereto, thereby constructing a hollow box 1 opened at its upper face. The guides 141 of the flat panel 14 are slidably engaged with the guide grooves 121 and 131 of both the left and right side panels 12 and 12 of the hollow box 1. As a result, a saving box in which the flat panel 14 is so disposed as an openable panel as to be openable in the opening portion of the box 1 is constructed.

Reference numeral 2 denotes a partition plate having a reflecting surface 20. The partition plate 2 is preferably formed of an opaque synthetic resin in a rectangular shape. The reflecting surface 20 is formed, for example, by bonding an aluminum foil or depositing aluminum on the surface of a thin flexible substrate of rectangular shape made of synthetic resin substantially in the same size as that of the partition plate 2. The reflecting surface 20 is superposed on the front surface of the partition plate 2. The partition plate 2 having the reflecting surface 20 is latched to the stepped portions 120 and 130 of the inner faces of both the left and right side panels 12 and 13 of the box 1 to be disposed on the diagonal lines of both the left and right side panels 12 and 13. The interior of the box 1 is thereby divided into two sections, one of which is formed along with the front panel 10 and the bottom panel 15, and the other with which is formed of the back panel 11 and the flat panel 14.

Reference numeral 3 denotes a pattern plate for camouflaging the edges of the partition plate 2 having the reflecting surface 20. The pattern plate 3 has a square-shaped bottom 30 having substantially the same size as that of the bottom panel 15, and both left and right sides 31 and 32 of a right-angled equilateral triangular shape having the same size as that of the front face side of the partition plate 2 (stepped portions 120, 130) of both the left and right side panels 12 and 13, and both the left and right sides 31 and 32 are erected at a right angle from both the left and right sides of the bottom 30. A fringe pattern extending from the front face toward the back face is formed on the inner face of the bottom 30. A lattice fringe pattern having fringes parallel to the bottom sides of both the left and right sides 31 and 32 of right-angled equilateral triangular shape and fringes crossing perpendicularly to the previous fringes is provided on each of the inner faces of both the left and right sides 31 and 32. The pattern plate 3 is disposed at the front face side partitioned by the partition plate 2 in the box 1, the bottom 30 is placed on the inner face of the bottom panel 15 with the fringe pattern, and the lattice fringe pattern is provided on the inner faces of both the left and right side panels 12 and 13 in contact with both the left and right sides 31 and 32. The pattern plate 3 may be adhered to the inner face of the bottom panel 15 or both the left and right side panels 12 and 13.

Reference numeral 4 denotes a light transmissible transparent plate of square shape made of a glass or synthetic resin plate. The transparent plate 4 is engaged with the stepped portion 101 of the front panel 10 and fixed thereto by adhesive or the like.

Numeral 5 denotes a sound absorbing member. The sound absorbing member 5 is made of a cushion material or the like, such as sponge, etc. The sound absorbing member 5 is disposed in a V shape on the back face partitioned by the partition plate 2 in the box 1 in contact with the partition plate 2 and the back panel 11. It is noted that the sound absorbing member 5 may be adhered to the partition plate 2 and the back panel 11.

Figure 4:
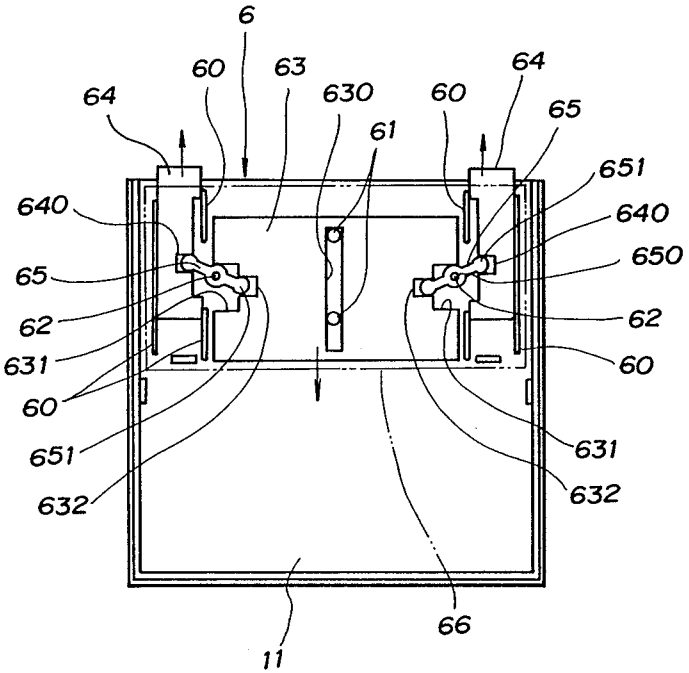

Numeral 6 denotes a locking mechanism. The locking mechanism 6 is disposed on the upper half of the inner face of the back panel 11. As seen in FIG. 4, the locking mechanism 6 has two guide ribs 60 protruding elevationally in parallel with one another at each of both left and right sides of the back panel 11. Thus, in total four guide ribs 60 are provided, and the intermediate portions of the inside guide ribs 60 of the four guide stripes 60 are removed. Two guide pins 61 are provided elevationally at a suitable interval at the center of the back panel 11. The elevational direction of the two guide pins 61 are parallel to the elevational directions of the four guide ribs 60. A pin 62 is provided between each of both the left and right side guide ribs 60 of the back panel 11 and the guide pin 61.

Numeral 63 denotes a plate strip-like weight of the locking mechanism 60, and the guide hole 630 is elevationally formed at the center of the weight 63. The intermediate portions of both the left and right sides of the weight 63 are removed. Recesses 632 are formed at the removed portions 631. The guide hole 630 of the weight 63 is engaged with the guide pin 61 so that the weight 63 is disposed elevationally slidably by the own weight of the weight 63 on the back panel 11 of the box 1. The sliding distance of the weight 63 is so adjusted by the length of the above-described guide hole 630 that the weight 63 may not protrude from the upper edge of the back panel 11.

Numeral 64 denotes plate-like locking units of the locking mechanism 6. A recess 640 is formed at the intermediate portion of each of the locking units 64 at one side thereof. The two locking units 64 are disposed elevationally slidably between the two left and right guide ribs 60 of the back panel 11 of the box 1.

Numeral 65 denotes a bar as a converting mechanism of the locking mechanism 6. A hole 650 is opened at the intermediate portion of the bar 65, and disc portions 651 are formed at both ends of the bar 65. The holes 650 of the two bars 65 are respectively rotatably engaged with the two pins 52 of the box 1, and the disc portions 651 of both the ends of the two bars 65 are respectively engaged with the recesses 632 of the weight 63 and the recesses 640 of the locking units 64. The bar 65 as the converting mechanism converts the sliding motion of the weight 63 to the sliding motion of the locking units 64, i.e., converts the upward sliding motion of the weight 63 (the direction toward the flat panel 14, hereinafter referred to as "upward") to the downward sliding motion of the locking units 64 (the direction toward the bottom panel 15, hereinafter referred to as "downward"), and the downward sliding motion of the weight 63 to the upward sliding motion of the locking units 64. The sliding distance of the locking units 64 is so adjusted by the length of the arm of the bar 65 as to be slid upward to be engaged with the locking hole 143 (see FIG. 3) and slid downward to be disengaged from the above-described locking hole 143.

Numeral 66 (see FIGS. 1 and 3) denotes a cover which is fixed to the upper half of the inner face of the back panel 11 to cover the locking mechanism 6.

Figure 2:
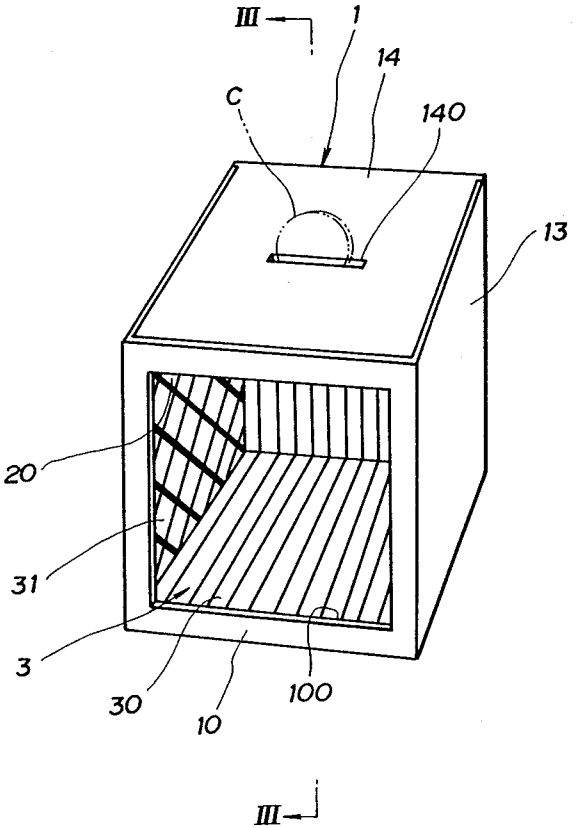

The saving box of this embodiment is constructed as described above, i.e., the partition plate 2 is disposed on the diagonal line in the box 1 to divide the interior of the box 1 into the two sections of the front face side and the back face side, and the reflecting surface 20 is disposed on the front face of the partition plate 2. Accordingly, as shown in FIG. 2, the fringe pattern and the lattice pattern of the pattern plate 3 of the inner face of the front face side of the box 1 partitioned by the partition plate 2 are reflected and projected on the reflecting surface 20. Thus, the fringe pattern and the lattice pattern projected on the reflecting plate 20 are observed as the fringe pattern and the lattice pattern of the inner face of the back face of the box 1 partitioned by the partition plate 2. As a result, when the interior of the box 1 is observed at a glance from the window 100 (transparent plate 4) of the front panel 10, it is observed such that there is no partition plate 2 having the reflecting plate 20.

Therefore, even if the interior of the box 1 is observed from the window 100 of the front panel 10, when a coin C is deposited from the inlet 140 of the flat panel 14 into the box 1, the coin C is constrained to the back face side partitioned by the partition plate 2 in the box 1 as shown in FIG. 3, and concealed by the partition plate 2 having the reflecting plate 20. Thus, the coin C is observed to be vanished In this manner, the coins C are accumulated without notice and the coins can be saved by playing mind, thereby visually pleasing it.

Particularly, in the saving box of this embodiment, the pattern plate 3 is disposed on the front face of the box 1 partitioned by the partition plate 2, the fringe pattern is provided on the inner face of the bottom panel 15, and the lattice fringe patterns are provided on the inner faces of both the left and right side panels 12 and 13. Therefore, the edge of the partition plate 2 having the reflecting surface 20 disposed on the diagonal line in the box 1 is comouflaged by the fringe pattern and the lattice fringe patterns, thereby further enhancing the vanishing effect of the coins C. Further, its decorating effect is enhanced.

Since the sound absorbing member 5 is disposed in the box 1 of the saving box of this embodiment, the sound in case of depositing the coin C in the box 1 is absorbed. As a result, the vanishing effect of the coin C is improved.

Further, since the saving box of this embodiment has the locking mechanism of the openable panel (flat panel 14), the flat panel 14 can be simply locked and unlocked by the following operations.

When the box 1 is disposed in an ordinary attitude state, i.e., in the state that the flat panel 14 is disposed upside, as shown in FIGS. 3 and 4, the weight 63 is disposed downward (at the side of the bottom panel 15, hereinafter referred to as "down"), and the locking unit 64 is disposed upward (at the side of the flat panel 14, hereinafter referred to as "up") to be engaged with the locking hole 143 of the flat panel 14, and the closed state of the flat panel 14 is locked. Accordingly, there is no possibility that the flat panel 14 is simply opened while remaining in this state.

Figure 5:
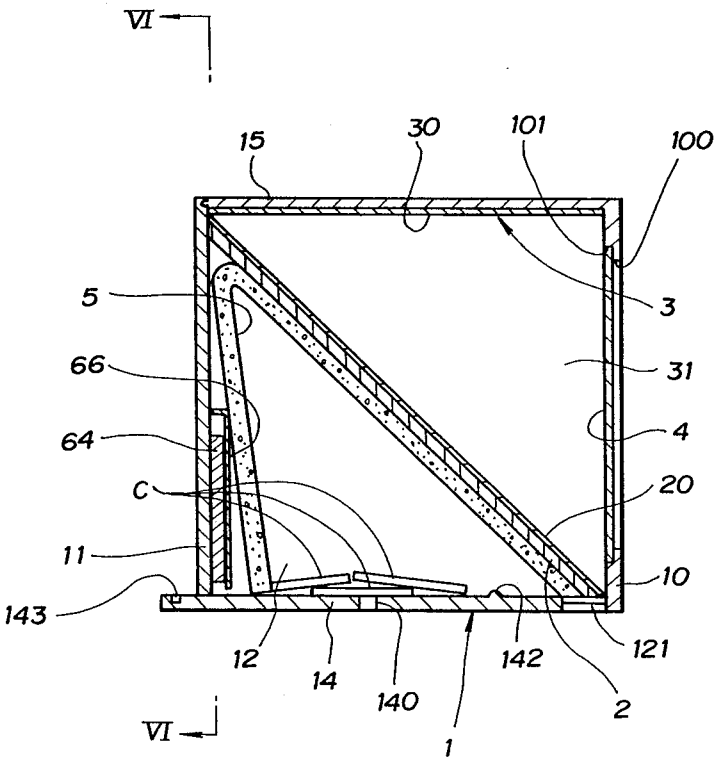
Figure 6:
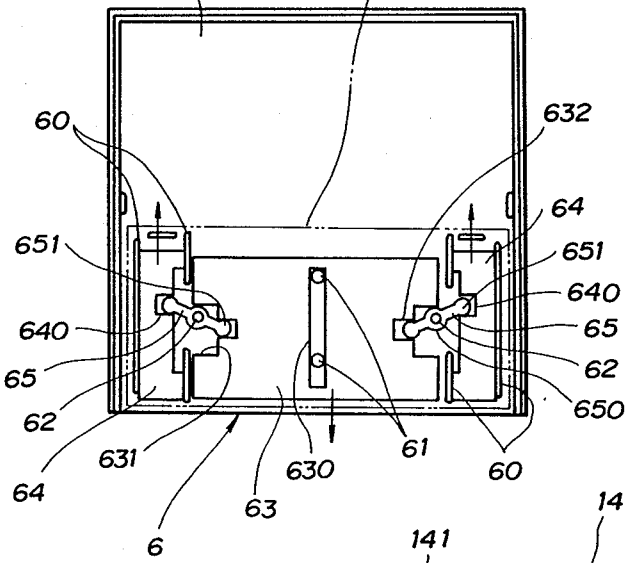
Figure 8:
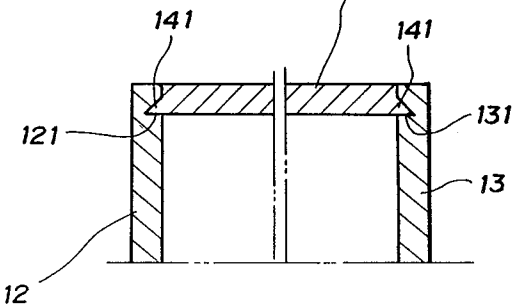

Here, when the coins C are accumulated and it is desired to open the flat panel 14, the box 1 is disposed upside down such that the flat panel 14 is directed down. Then, as shown in FIGS. 5 and 6, the weight 63 is slid downward by its own weight as shown by an arrow, the locking unit 64 is slid up through the bar 65 as shown by an arrow to be removed from the locking hole 143, and unlocked. When the flat panel 14 is slid toward the back panel 11 in this state, as shown in FIGS. 5 and 7, the flat panel 14 can be simply opened. The stopper 142 of the flat panel 14 is contacted with the edge of the opening of the box 1 (the upper edge of the back panel 11) at this time, so that there is no possibility that the flat panel 14 is removed from the opening of the box 1.

Then, the box 1 is again disposed upside down, the flat panel 14 is directed up, the box 1 is returned to its ordinary attitude, and the flat panel 14 is closed in this state. Then, as shown in FIGS. 3 and 4, the weight 63 is slid down by its own weight as shown by an arrow, the locking units 64 are slid up through the bars 65 as shown by an arrow to be engaged within the locking hole 143. As a result, the closing state of the flat plate 14 is simply locked.

Therefore, the locking operation or the unlocking operation can be simply performed without using a key.

The sliding motion of the weight 63 is parallel to and reverse to that of the locking units 64 in the above-described locking mechanism 6. However, the present invention is not limited to the particular embodiment. That is, the mechanism may be constructed such that the weight 63 is slid by its own weight by altering the attitude of the box 1, the locking unit 64 is slid to be engaged with the locking hole 143 or disengaged therefrom, the closed state of the flat panel 14 is locked, or the flat panel 14 is unlocked.

In the embodiment described above, the locking units 64 of the locking mechanism 6 are two. However, the number of the locking units 64 is not particularly limited.

Further, in the above-described locking mechanism 6, the weight 63 and the locking unit 64 are formed of thin plates. Therefore, the entire locking mechanism 6 is reduced in thickness. As a result, it is optimum as the locking mechanism of the openable panel (flat panel 14) of the above-described saving box.

Figure 9:
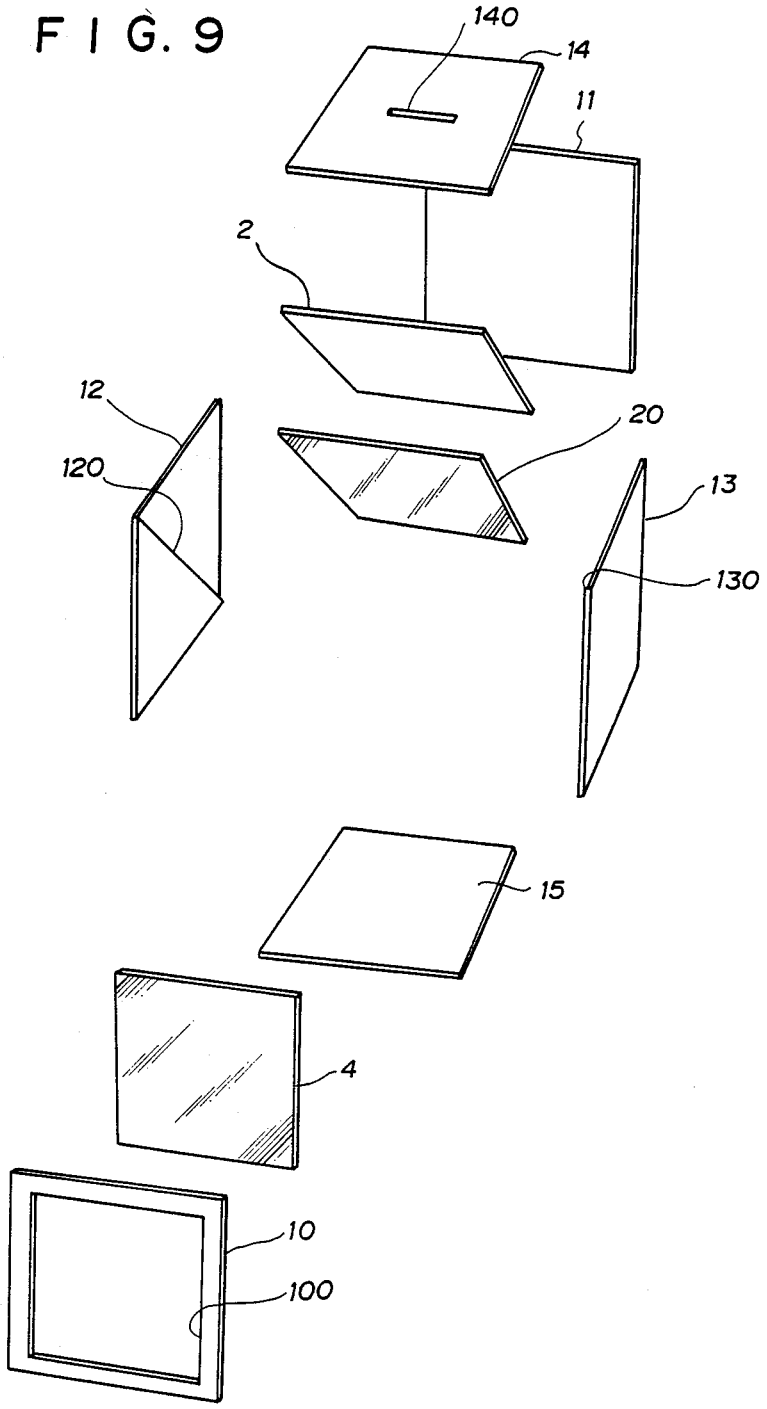
Figure 11:
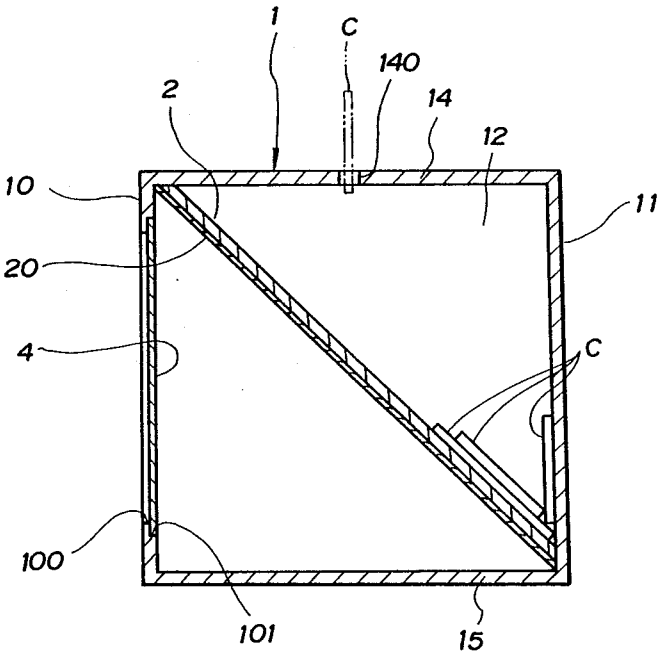
Figure 10:
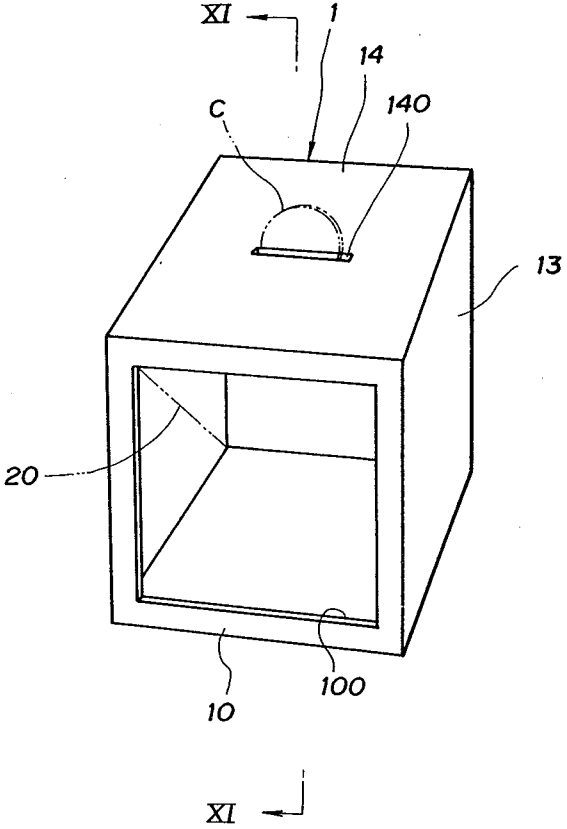

FIGS. 9 to 11 show the most fundamental example of the examples of the box of the present invention as a saving box.

In the drawings, the same reference numerals as those in FIGS. 1 to 8 denote the same or equivalent components.

In the saving box of this embodiment, the pattern plate 3, the sound absorbing member 5 and the locking mechanism 6 are removed from the components of the saving box of the above-described first embodiment, and a flat panel 14 is fixed to a front panel 10, a back panel 11 and both left and right side panels 12 and 13. That is, in the saving box of this embodiment, a window 100 is provided at the front panel 10 of the stereoscopic box 1. Partition plate 2 is disposed on parallel diagonal lines of opposite two panels of the front panel 10 opened with the window 100 and four panels except the back panel 11 opposite to the front panel 10, such as both left and right side panels 12 and 13 in the box 1, the interior of the box 1 is divided into two spaces, and a reflecting surface 20 is disposed on the surface of the partition plate 2 opposite to the window 100 as the most fundamental embodiment.

In the saving box of this embodiment, the partition plate 2 is disposed on the diagonal line in the box 1 to divide the box 1 into the front face side and the back face side, and the reflecting plate 20 is disposed on the front face of the partition plate 2. Accordingly, as shown in FIG. 10, the inner face of the front face side in the box 1 partitioned by the partition plate 2 is reflected and projected to the reflecting surface 20. Thus, the inner face projected on the reflecting surface 20 is observed as the inner face of the back face side in the box 1 partitioned by the partition plate 2. As a result, when the interior of the box 1 is observed from the window 100 (transparent plate 4) of the front panel 10 at a glance, it is observed as having no partition plate 2 having the reflecting surface 20.

Therefore, even if the box 1 is observed from the window 100 of the front panel 10, when a coin C is deposited from the deposit port 140 of the flat panel 14 into the box 1, as shown in FIG. 11, the coin C is contained in the back face side partitioned by the partition plate 2 in the box 1, and concealed by the partition plate 2 having the reflecting surface 20. Accordingly, the coin C is observed as being vanished. In this manner, the coins C are accumulated without notice, can be saved by playing mind, thereby pleasing visually.

In the second embodiment described above, the flat panel 14 provided with the coin deposit port 140, the front panel 10, the back panel 11 and both the left and right side panels 12 and 13 are integrally fixed. However, the flat panel 14 may be slidably construed.

Figure 13:
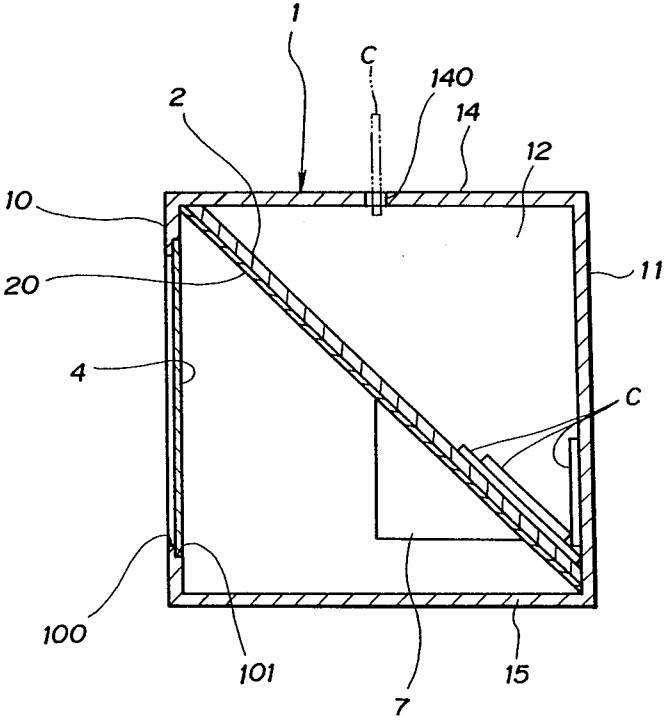
FIG. 13 is a sectional view taken along the line XIII—XIII in FIG. 12.
Figure 12:
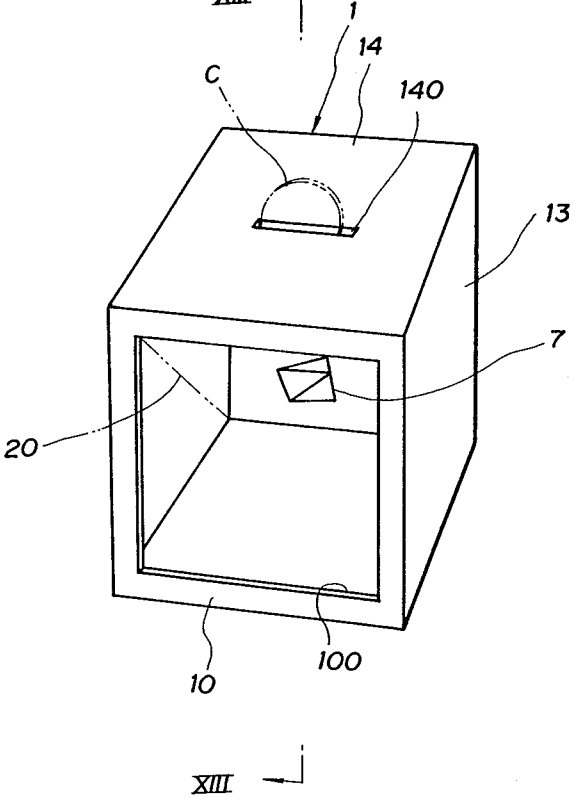
FIG. 12 is a perspective view showing a third embodiment of a box in which an ornament is provided in the saving box of the above-described second embodiment.

FIG. 12 is a perspective view showing a third embodiment of a box of the invention in which an ornament is provided in combination with the saving box of the second embodiment, and FIG. 13 is a sectional view taken along the line XIII—XIII in FIG. 12.

This embodiment is a modified example of the above-described second embodiment. In the drawings, the same reference numerals as those in FIGS. 1 to 11 denote the same or equivalent components.

In the drawings, reference numeral 7 denotes an ornament. The ornament 7 is made, for example, of synthetic resin, is formed in a quadrangular prism shape of square bottom, and the bottom of the ornament 7 is fixed directly by adhering onto a reflecting surface 20.

Since the saving box of this embodiment has the ornament 7 fixed onto the reflecting surface 20, the partition plate 2 having the reflecting surface 20 is not observed by the reflecting operation of the above-described reflecting surface 20. As a result, the ornament 7 of the stereoscopic shape (which is actually formed in a quadrangular pyramid shape, but observed as a stereoscopic shape by the quadrant reflected to the reflecting surface 20) is observed as to float in the hollow box 1, thereby being pleasant to look at and enhancing the decorating effect. Further, saving can be pleasantly performed in the same manner as the saving box of the first and second embodiments.

Figure 14:
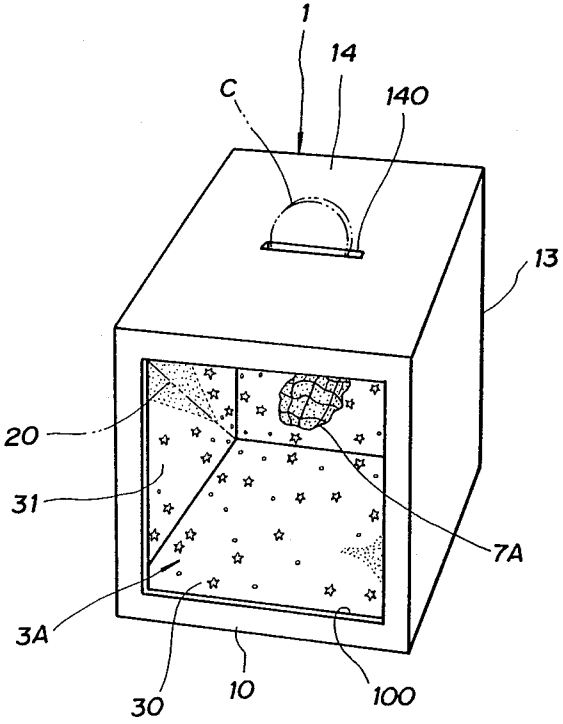
FIG. 14 is a perspective view showing a fourth embodiment in which an ornament or a pattern is provided in the saving box of the above-described second embodiment.

FIG. 14 is a perspective view showing a fourth embodiment in which an ornament or a pattern, etc, is provided in the saving box of the above-described second embodiment.

This embodiment is modified from the saving box of the first, second and third embodiments described above. In the drawings, the same reference numerals as those in FIGS. 1 to 13 denote the same or equivalent components.

In the saving box of this embodiment, the pattern of a pattern plate 3A is formed, for example, by scattering numerous stars on a black base, an ornament 7A as a shooting star or meteorite is fixed on the reflecting surface 20, the star or meteorite is observed as being floated in a space, thereby being pleasant to look at. Further, the same operation and effect as those of the saving box of the above-described first, second and third embodiments can be performed. Moreover, it has utility value not only as the saving box but as an ornament.

Figure 15:
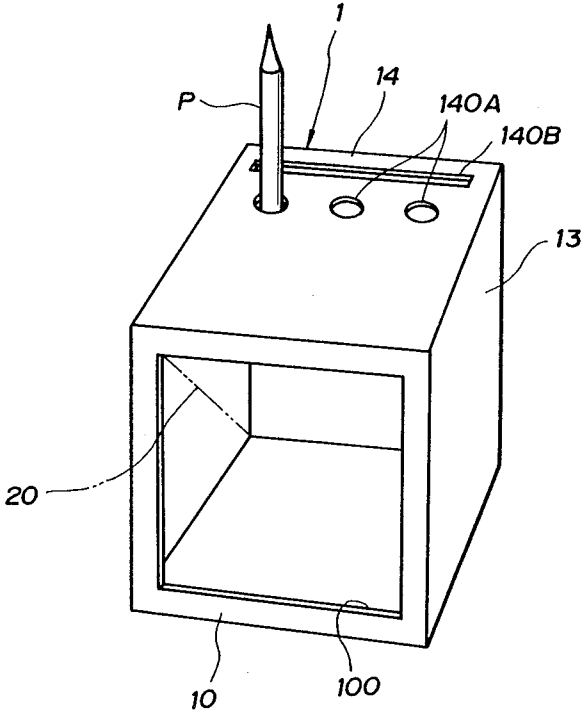
FIG. 15 is a perspective view showing a fifth embodiment of a box for use as a pencil stand box according to the present invention.

FIG. 15 shows a perspective view showing a fifth embodiment of a box according to the present invention for use as a pencil stand box.

This embodiment is an example of a pencil stand box. In the drawing, the same reference numerals as those in FIGS. 1 to 14 denote the same or equivalent components.

The pencil stand box of this embodiment is provided with three disc-shaped pencil insertion holes 140A on a flat panel 14 near the back panel 14 and a slender card insertion hole 140B.

Since the pencil stand box of this embodiment is constructed as described above, when a pencil P is inserted, for example, in the pencil insertion hole 140A, the portion of the pencil P inserted into the box 1 is observed as being vanished by the reflecting operation of a reflecting surface 20, thereby pleasing as the pencil stand box. Further, when a card is inserted into the card insertion hole 140B, the inserted portion of the card is observed as being vanished, thereby being pleasant to observe.

Figure 16:
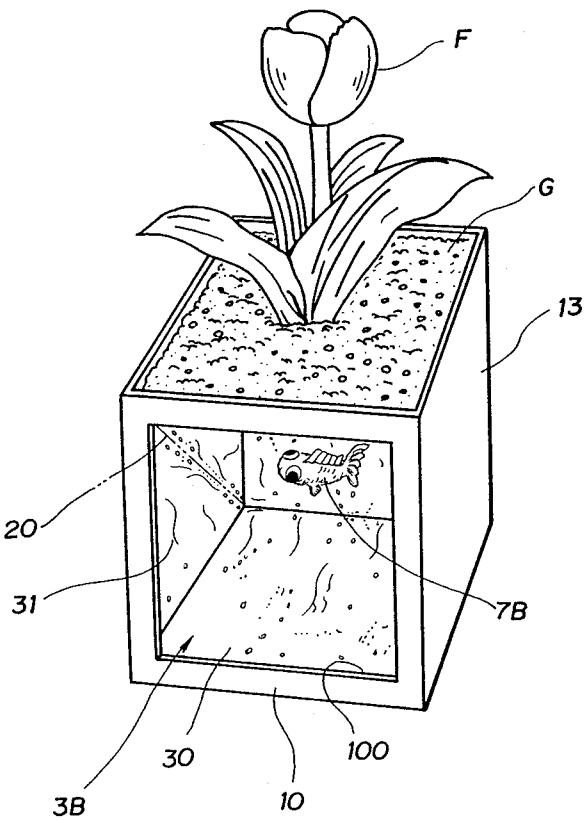
FIG. 16 is a perspective view showing a sixth embodiment of a box for use as a flower stand box according to the present invention.

FIG. 16 is a perspective view showing a sixth embodiment of a box according to the present invention for use as a flower stand box.

This embodiment is an example of a flower stand box. In the drawing, the same reference numerals as those in FIGS. 1 to 15 denote the same or equivalent components.

The flower stand box of this embodiment has no flat panel. The flat face of the flower stand box is opened, soil (or quasi-soil similar to the soil) G is filled in the space opposite to the space at the side of a window 100 in the box 1 partitioned by a partition plate 2 having a reflecting surface 20, and a flower (or artificial flower) F is planted in the soil. On the other hand, a pattern plate 3B is of an underwater pattern, and an ornament 7B is of a goldfish.

As a result, the flower stand box of the embodiment is observed as being a goldfish basin by the reflecting operation of the reflecting surface 20, can be applied not only as a flower stand box but as an ornament, thereby being pleasing to look at.

Figure 17:
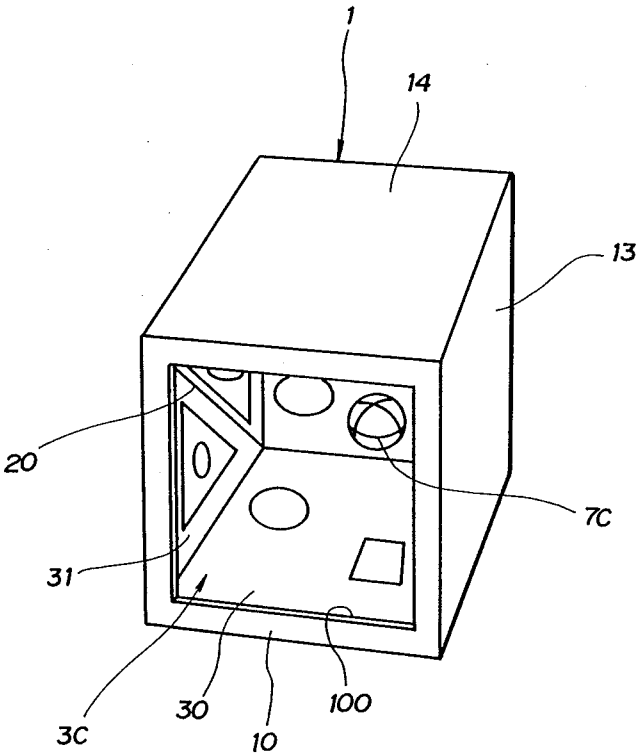
FIG. 17 is a perspective view showing a seventh embodiment of a box for use as a stock box according to the present invention.

FIG. 17 is a perspective view showing a seventh embodiment of a box according to the present invention for use as a stock box.

This embodiment is an example of a stock box. In the drawing, the same reference numerals as those in FIGS. 1 to 16 denote the same or equivalent components.

In the stock box of this embodiment, a flat panel 14 is detachable, a pattern plate 3C has a geometrical pattern, and a semispherical ornament 7C is fixed on a reflecting surface 20.

Since the stock box of this embodiment is constructed as described above, even if an article is stocked in a space opposite to the space of a window 100 side in the box 1 partitioned by a partition plate 2 having the reflecting surface 20, the article stored in the above-described space is observed as being vanished by the reflecting operation of the reflecting surface 20, thereby pleasing as the stock box.

When the flat panel 14 of the box 1 is fixed and visual effect articles, such as ornaments 7 to 7C and pattern plates 3 3C are disposed in the box 1, it can be applied as an ornament.

Figure 18:
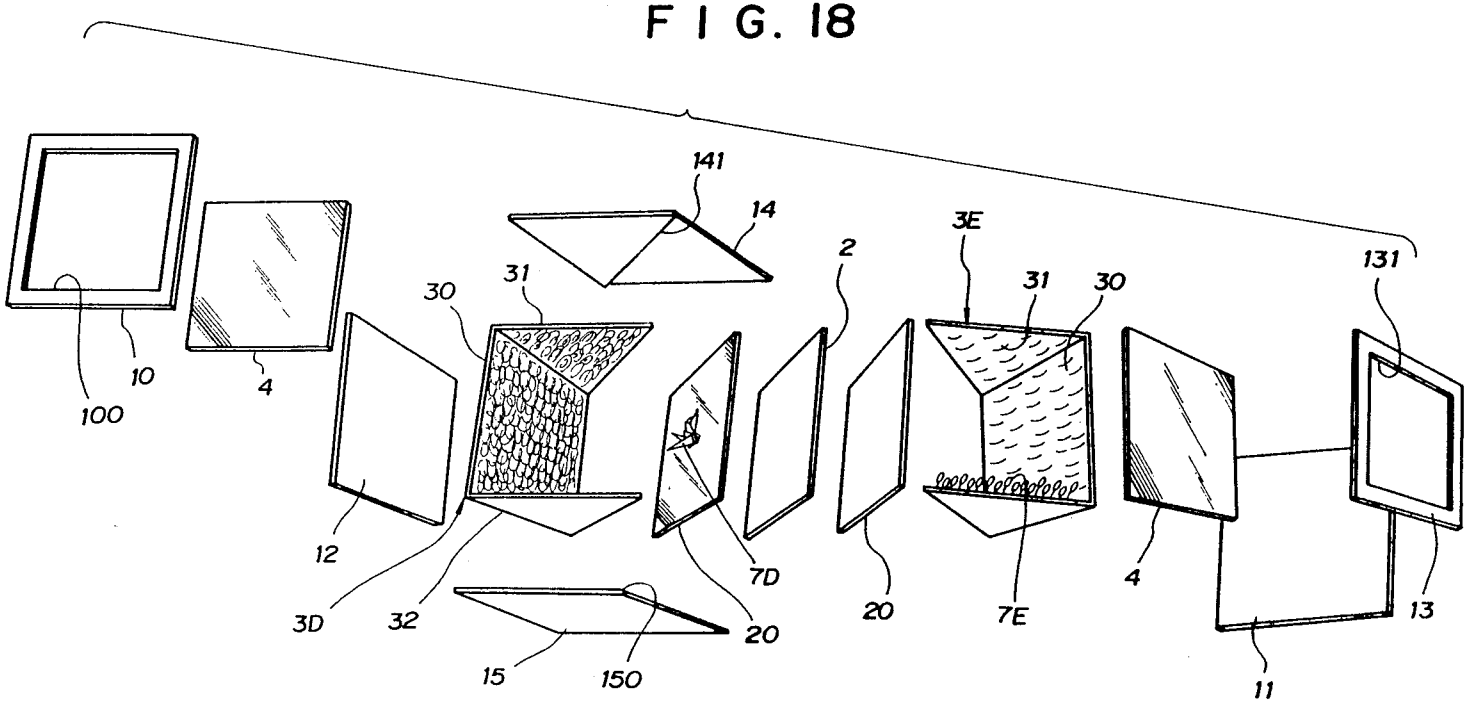
Figure 20:
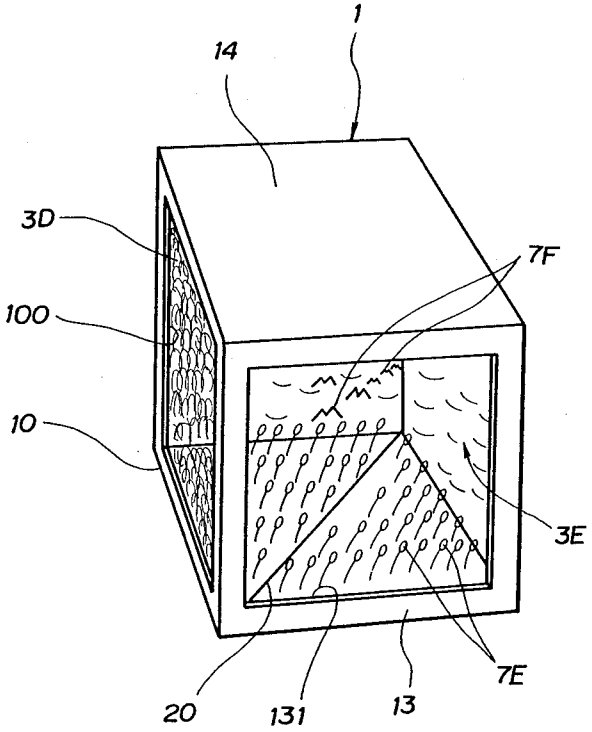
Figure 19:
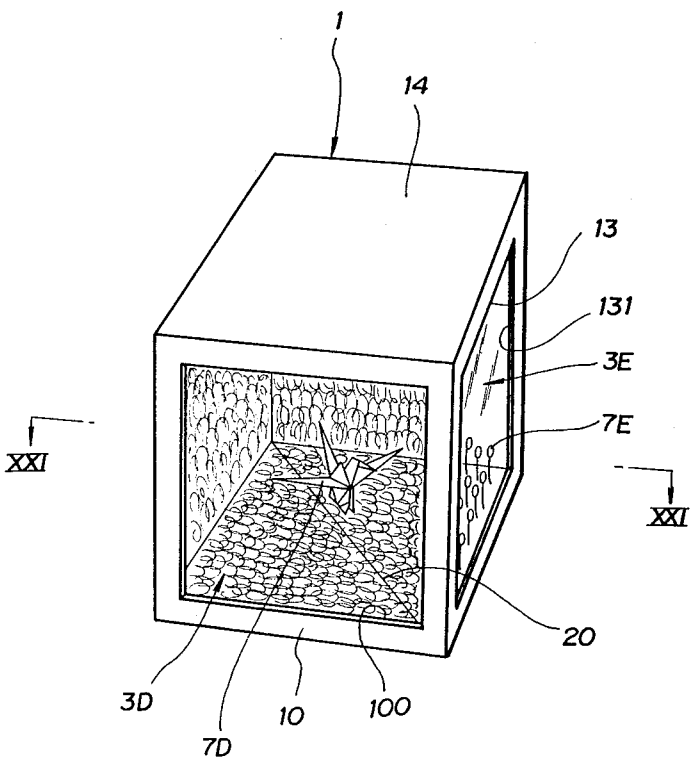
Figure 21:
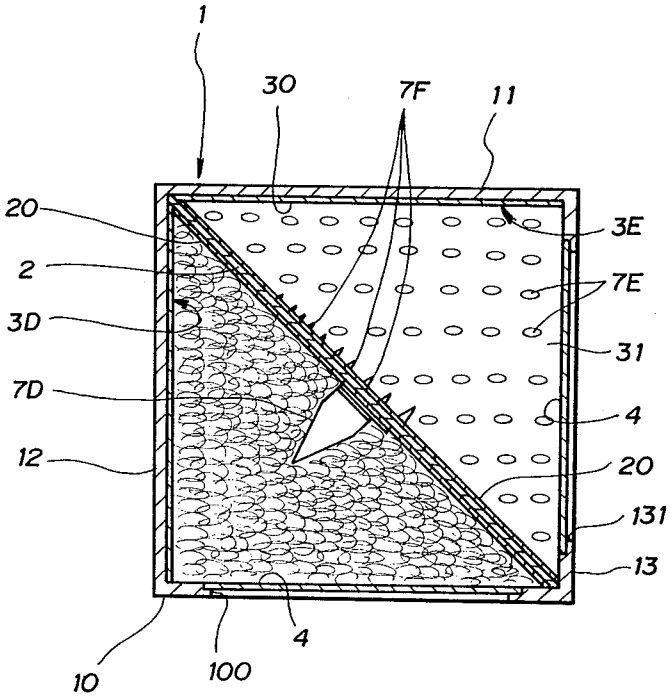

FIGS. 18 to 21 show eighth embodiment of a box according to the present invention for use as an ornament box. FIG. 18 is an exploded perspective view of a box of stereoscopic shape, FIG. 19 is a perspective view of a front face side, FIG. 20 is a perspective view of the right side face, and FIG. 21 is a sectional view taken along the line XXI—XXI in FIG. 19.

This embodiment is of an ornament box. In the drawings, the same reference numerals, as those in FIGS. 1 to 17 denote the same or equivalent components.

The ornament box in this embodiment has, in the box of the above-described first to seventh embodiments, a flat panel as a left side panel 13, a left side panel as a flat panel 14, a right side panel as a bottom panel 15, a bottom panel as a left side panel 12, and a window 131 opened at the above-described right side panel 13. Stepped portions 141 and 150 are provided on parallel diagonal lines of the inner faces of two adjacent front panels 10 provided with windows 100 and 131, the right side panel 13 and its front panel 10, the right side panel 13 and the opposite back panel 11, the flat panel 14 except the left side panel 12 and the bottom panel 15. The reflecting surfaces 20, 20 are disposed on both the faces of the partition plate 2. A pattern plate 3D of the front face side has a color figured pattern, an ornament 7D of the front face side has a half of a folded-paper crane, and fixed by adhering on the reflecting surface 20. On the other hand, a pattern plate 3E of the right side face has a vacant pattern, an ornament 7E of the right side face has wild grasses, and fixed on the pattern plate 3E. Further, ornaments 7F of the right side face are aligned as wild geese on the reflecting surface 20.

Since the ornament box of this embodiment is constructed as described above, when the box 1 is observed from the window 100 of the front panel 10, the folded-paper crane is observed as being floated in the color figured pattern by the reflecting operation of the reflecting surface 20. When the box 1 is observed from the window 131 of the right side panel 13, the wild geese are similarly observed as being flown in the sky of a field by the reflecting operation of the reflecting surface 20. Thus, the pattern plates 3D, 3E and the ornaments 7D, 7E, 7F in the box 1 observed from both sides are different, thereby enhancing the decorating effect and visually pleasing as the ornament box.

In the embodiment described above, the different pattern plates 3D, 3E and the ornaments 7D, 7E, 7F are disposed in the two spaces of the box 1. However, only the different pattern plates may be disposed in the two spaces, or only the different ornaments may be disposed in the two spaces.

Figure 22:
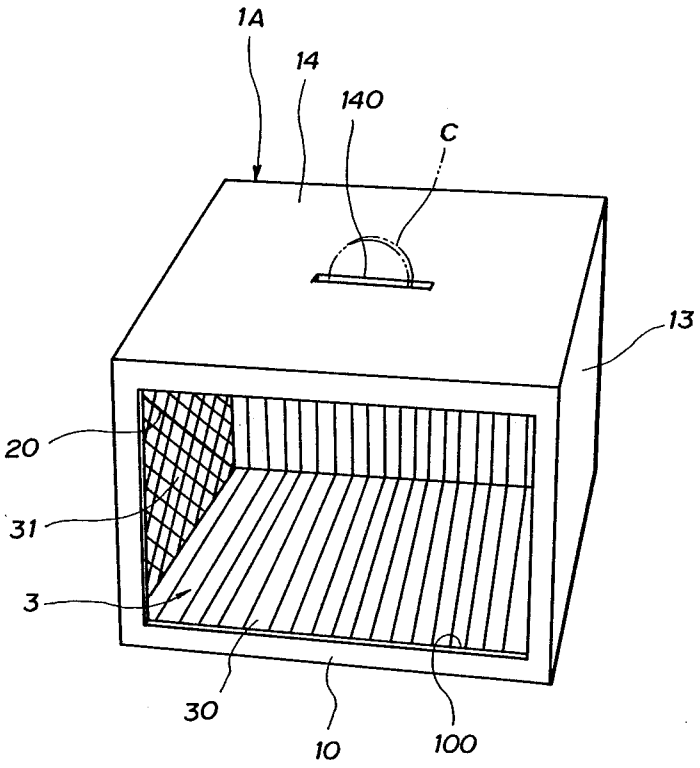
FIG. 22 is a perspective view showing a ninth embodiment of a box for use as a saving box of a rectangular parallelepiped shape according to the invention.

FIG. 22 is a perspective view showing a ninth embodiment of a box according to the invention for use as a saving box of a rectangular parallelepiped shape.

The box of this embodiment has a box 1A of rectangular parallelepiped shape having equal heights and depths. In this embodiment, if the heights and the depths are equal, the lengths of the sides are free. The other structure is the same as those in the embodiments in FIGS. 1 to 17.

In the embodiments described above, the partition plate 2 and the reflecting surface 20 are separately formed. However, the reflecting surface 20 may be provided directly on the front face of the partition plate 2.

In the embodiments described above, the pattern plates 3 to 3E having fringe patterns or lattice fringe patterns are employed. However, patterns may be provided directly on the inner faces of the box 1, lA without employing the pattern plates 3 to 3E.

Further, in the embodiments described above, the transparent plates 4 are disposed on the windows 100, 132. However, the transparent plate 4 may be omitted.

What is claimed is:

1. A box comprising:

a box body having six opaque panels;

a light transmissible window provided at one panel of the box body, a partition plate for dividing the interior of the box body into two spaces and which is disposed on a plane defined by one diagonal line of a given panel among the four panels abutting the panel formed with the window and another diagonal line of a panel opposite to the given panel and parallel to the diagonal line of the given panel; and a light-reflective area provided on a surface of the partition plate substantially over the entire surface thereof and facing the window.

2. The box according to claim 1, further comprising a coin deposit port provided on at least one panel forming the space opposite to that of the window side so as to communicate with said space.

3. The box according to claim 2, wherein said panel provided with said coin deposit port is openable.

4. The box according to claim 3, further comprising a locking mechanism for locking said openable panel when in a closed state.

5. The box according to claim 4, wherein the locking mechanism comprises a weight disposed slidably in the box body to be slid by its own weight, a locking unit slidably disposed in the box body, a converting mechanism for converting the sliding motion of the weight provided at the locking unit into that of the locking unit, and a locking hole provided at a portion of the openable panel opposite to the locking unit at the time of closing the openable panel for locking the openable panel in the closed state by engaging it with the locking unit at the time of ordinary attitude state of the box body.

6. The box according to claim 1, wherein one panel forming the space opposite to that of the window side and which faces the partition plate and locates in adjacent to the panel formed with the window has at least one round-shaped hole communicating with said space, thereby said space defining an accommodation space for articles.

7. The box according to claim 1, wherein one panel forming the space opposite to that of the window side and which faces the partition plate and locates in adjacent to the panel formed with the window has a large square hole communicating with said space, thereby said half space defining an accommodation space for articles.

8. The box according to claim 1, wherein one panel forming the space opposite to that of the window side and which faces the partition plate and locates in adjacent to the panel formed with the window is detachable.

9. The box according to any of claims 1 to 4, 6, 7 and 8, wherein an ornament is disposed in the space of the window side.

10. The box according to any of claims 1 to 4, 6, 7 and 8, wherein a design or a pattern is provided on at least one panel forming the space of the window side.

11. The box according to any of claims 1 to 4, 6, 7 and 8, wherein an ornament is disposed in the space of the window side and a design or pattern is provided on at least one panel forming the space of the window side.

12. A box comprising:

a box body having six opaque panels;

two light transmissible windows provided at two adjacent panels of the box body;

a partition plate for dividing the interior of the box body into spaces and which is disposed on a plane defined by one diagonal line of a given panel that abuts both of the panels formed with the windows and one diagonal line of another panel facing the given panel and parallel to the diagonal line of the given panel; and two light-reflective areas provided on both surfaces of the partition plate, each light-reflective area covering substantially the entire surface of each of the surfaces of the partition plate that face the windows.

13. The box according to claim 12, wherein different ornaments are disposed in the two spaces, respectively.

14. The box according to claim 12, wherein different designs or patterns are provided on the panels forming the respective spaces.

15. The box according to claim 12, wherein different ornaments are disposed in the two spaces, respectively and different designs or patterns are provided on the panels forming the respective spaces.

16. The box according to claim 10, wherein different designs or patterns are provided on surfaces of different pattern-plates disposed separately on the panels forming the space of the window side.

17. The box according to claims 14 or 15, wherein different designs or patterns are provided on surfaces of different pattern-plates disposed separately on the panels forming the respective spaces.

18. The box according to claim 10, wherein said designs or patterns are provided directly on the panels forming the space of the window side.

19. The box according to claims 14 or 15, wherein said designs or patterns are provided directly on the panels forming the respective spaces.

20. The box according to claim 1, wherein said light-reflective area is formed on another sheet or plate attached to the partition plate.

21. The box according to claim 12, wherein said light-reflective area formed on other two plates attached to the front and rear surfaces of the partition plate, respectively.

22. The box according to claim 1, wherein said light-reflective area is formed directly on the partition plate.

23. The box according to claim 12, wherein said light-reflective areas are formed directly on the front and rear surfaces of the partition plate.

24. The box according to claim 1, wherein said panel formed with the window is adapted to be partly transparent.

25. The box according to claim 12, wherein said panels formed with the respective windows are adapted to be partly transparent.

* * * * *